US005607237A

United States Patent [19]

LaFleur

[11] Patent Number: 5,607,237

[45] Date of Patent: Mar. 4, 1997

[54] BULK BAG WITH LIFT STRAPS

[75] Inventor: Lee LaFleur, Manistee, Mich.

[73] Assignee: Custom Packaging Systems, Inc., Manistee, Mich.

[21] Appl. No.: 629,552

[22] Filed: Apr. 9, 1996

[51] Int. Cl.[6] ..... B65D 33/14; B65D 33/02

[52] U.S. Cl. ..... 383/22; 383/17; 383/117; 383/119

[58] Field of Search ..... 383/16, 17, 22, 383/24, 105, 119, 117

[56] References Cited

U.S. PATENT DOCUMENTS

| | | | |
|---|---|---|---|
| 4,271,883 | 6/1981 | Krause | 383/24 X |
| 4,499,599 | 2/1985 | Polett et al. | 383/24 X |
| 4,790,029 | 12/1988 | LaFleur et al. . | |
| 4,792,239 | 12/1988 | Hamada et al. al. | 383/16 X |
| 5,104,236 | 4/1992 | LaFleur . | |
| 5,127,893 | 7/1992 | LaFleur . | |

FOREIGN PATENT DOCUMENTS

| | | | |
|---|---|---|---|
| 5124652 | 5/1993 | Japan | 383/24 |
| 1394226 | 5/1975 | United Kingdom | 383/24 |
| 2097755 | 11/1982 | United Kingdom | 383/17 |

OTHER PUBLICATIONS

Abstract from Official Gazette of Dec. 7, 1992 Pat. No. 4,362,199 – Flexible Containers.

*Primary Examiner*—Jes F. Pascua

*Attorney, Agent, or Firm*—Barnes, Kisselle, Raisch, Choate, Whittemore & Hulbert

[57] ABSTRACT

A generally cubical collapsible bag with six generally rectangular walls of a flexible woven fabric material. Lift straps attached adjacent two opposed top edges of the bag, are connected by a pair of substantially inextensible linking members. Preferably, each linking member connects two corner lift straps and an intermediate lift strap between them.

13 Claims, 1 Drawing Sheet

BULK BAG WITH LIFT STRAPS

FIELD OF THE INVENTION

This invention relates to shipping and storage containers and more particularly to the lift straps of a collapsible bulk bag.

BACKGROUND OF THE INVENTION

Previously, many granular products and some liquids have been shipped and stored in large bulk bags which may contain as much as a ton or more of material. Some of these bulk bags are flexible and when empty can be folded to a generally flat condition. One such flexible bag is disclosed and claimed in U.S. Pat. No. 4,790,029.

U.S. Pat. No. 5,127,893 discloses a bulk bag of woven fabric with four lift straps attached to selected reinforced areas of fabric at the side edges of the bag. These lift straps move independently and are difficult to align onto the tines of a lift truck. Further, when the bag is positioned onto a lifting tine the loop portion of the lift straps tends to move laterally, away from the bag. This lateral movement produces an offset loading when the bag is lifted, which tends to tear the straps from the bag.

These previous bags have only four lift straps at their side edges which provides a poor distribution of the load on the bag fabric. This results in relatively high strsses on the bag fabric that limits the load bearing capability. Thus, to carry increasingly heavier loads the previous bag design would have to be further reinforced or made from heavier fabric which increases the cost of the bag.

SUMMARY OF THE INVENTION

A collapsible bulk bag with three lift straps along each of two opposed top edges which are preferably attached to a plurality of laterally spaced apart reinforced areas of the side walls. Preferably, when filled, the bags have a substantially cubical configuration and when empty can be folded into a flat and compact arrangement. Preferably, each lift strap is attached to a pair of reinforced areas or strips of the bag fabric. Preferably, one strap is adjacent each of the four upper corners of the bag and one strap is adjacent the upper edge and in the middle of two generally opposed sides of the bag. Along each top edge a substantially inextensible linking member is connected to the lift straps adjacent the corners of the bag and passes through the middle lift strap between them.

In one form, the linking member is a flexible web of material connected with a pair of corner lift straps and with an overall length such that when in tension, these corner lift straps are substantially parallel to each other. In another form, the linking member is a hollow, elongate tube connected to and extending between a pair of corner lift straps and passing through the middle lift strap between them. Preferably, the tube has an oval cross-section with major and minor diameters sufficient to allow facile insertion of a lifting tine into an open end of the tube. Preferably, the tube has upper and lower wall portions with a section of the lower wall portion removed from both ends of the tube such that the upper wall portion projects beyond the lower wall portion at both ends of the tube. This arrangement helps to align a lifting tine with the tube and facilitates the insertion of the tine through the tube, and hence, through the lift straps of the bag.

Objects, features and advantages of this invention are to provide an arrangement of the lift straps of a collapsible bag which greatly improves the alignment of the lift straps with a lifting tine, facilitates the movement of a lifting tine through the lift straps, limits the independent lateral movement of the lift straps away from the bag when suspended by the lift straps, when lifted by the straps eliminates the tendency for them to tear away from the bag, when lifted by the straps improves the load distribution on the bag, improves the load bearing capacity of the bag while minimizing the quantity, weight and cost of the fabric material of the bag, does not inhibit stacking or storage of the bag, and is of relatively simple, economical and reliable design and manufacture.

BRIEF DESCRIPTION OF THE DRAWINGS

These and other objects, features and advantages of the invention will be apparent from the following detailed description of the preferred embodiment and best mode, appended claims and accompanying drawings in which:

DETAILED DESCRIPTION OF THE PREFERRED EMBODIMENTS

Figure 1:
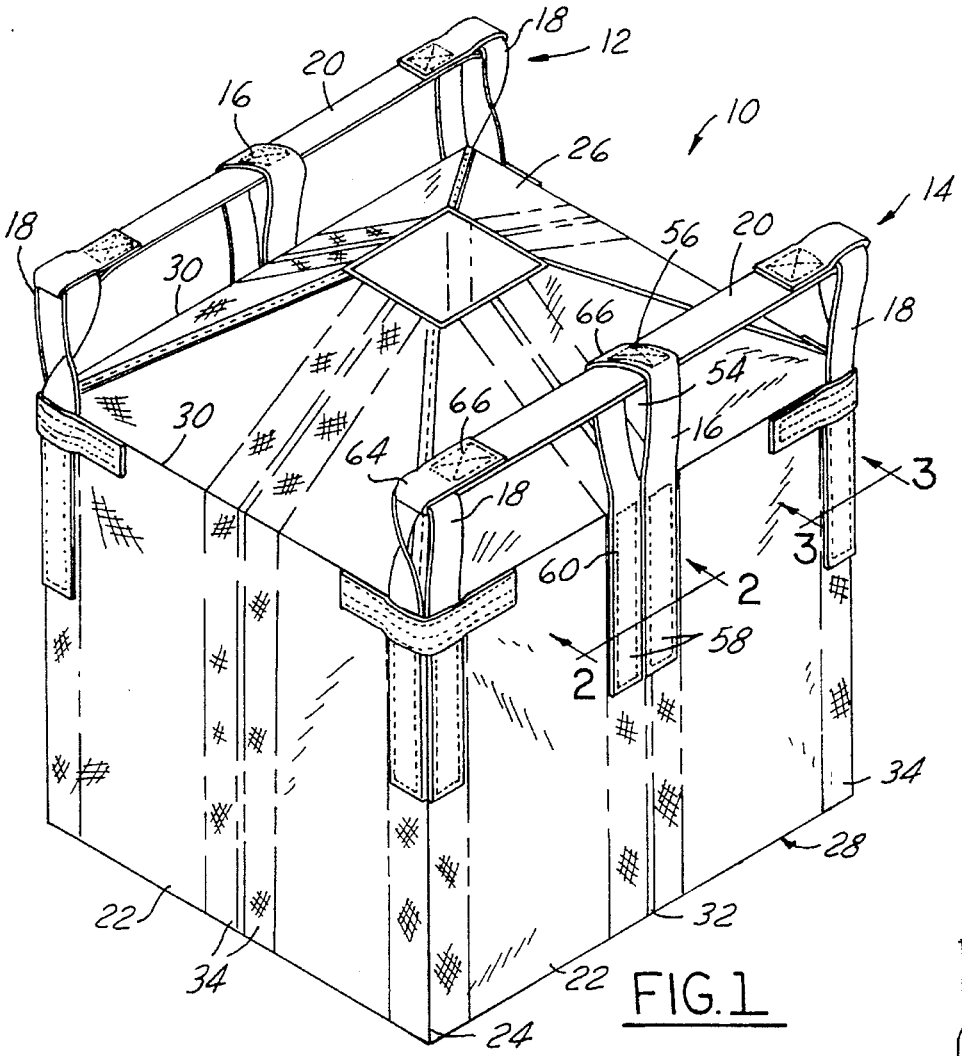
FIG. 1 is a perspective view of a reinforced collapsible bag when expanded with lift straps embodying this invention.

FIG. 1 illustrates a bag 10 with two sets of lift straps 12 & 14 embodying this invention, each with an intermediate strap 16 and a pair of end or corner straps 18 interconnected by a linking web 20 which passes through the intermediate strap.

Preferably, the bag, when expanded and filled is generally cubical with four generally rectangular or square side walls 22 interconnected along their adjacent side edges 24 and rectangular or square top and bottom ends 26 & 28 connected along their outer edges 30 with an adjacent side wall. Preferably, to facilitate collapsing and folding the bag, the top 26, bottom 28 and one pair of opposed side walls 22 have pleats or fold lines 32 therein. Preferably, the top 26, bottom 28 and side walls 22 of the bag are made of a woven fabric material, such as woven polyethylene and woven polypropylene fabrics. If a leak-proof bag is required, preferably a second bag or liner of a flexible plastic film can be received in the bag 10 of woven fabric material, preferably with both bags having the same configuration.

Figure 2:
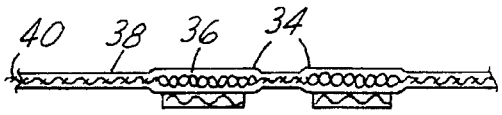
FIG. 2 is a fragmentary sectional view taken on line 2—2 of FIG. 1 illustrating the attachment of the lift straps to the reinforcing strips in a side of the bag.
Figure 3:
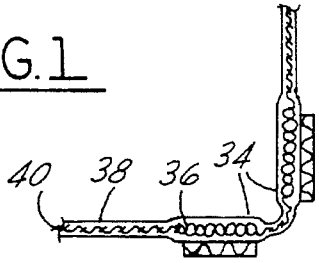
FIG. 3 is a fragmentary sectional view taken on line 3—3 of FIG. 1 illustrating the attachment of the lift straps to the reinforcing strips at a side edge of the bag.

Preferably, to provide a bag 10 with a higher strength to weight ratio and of reduced cost, the woven fabric material has reinforced areas or strips 34 extending longitudinally, which are preferably formed by weaving in the fabric. As shown in FIGS. 2 and 3, each strip 34 has a plurality of warp threads 36 spaced closer together than the warp threads 38 in the other areas of the woven fabric. Thus, each reinforced strip 34 has a greater density of warp threads 36 than the density of warp threads 38 in the other, or non-reinforced areas of the woven material. All of the warp threads 36 & 38 are of the same material and have substantially the same nominal diameter and tensile strength. Preferably, all of the warp threads 36, 38 and the weft threads 40 are the same material and substantially the same nominal diameter and tensile strength. Preferably, the reinforcing strips 34 extend around substantially the entire periphery of the bag in the central portion of its sides 22 and ends 26,28, and along the side edges 24 of the bag, such that each blank preferably has eight pairs of reinforcing strips 34. The eight pairs of reinforcing strips 34 are laterally spaced apart substantially equally throughout the circumference of the side walls 22 of the bag.

Preferably, both the side walls 22 and end walls 26,28 of the bag 10 are constructed from a one piece circular blank of woven fabric material essentially without any scrap in accordance with the bag construction and method disclosed and claimed in U.S. Pat. Nos. 5,104,236 and 5,127,893, the disclosures of which are incorporated herein by reference. Hence, the basic construction and arrangement of the bag per se will not be described in further detail.

To facilitate suspending the bag, such as for filling, lifting and moving the bag, the two sets of lift straps 12, 14 are attached to the upper end of the bag adjacent a pair of its opposed top edges 30. Preferably, each set has a pair of outer or corner lifts straps 18 and one or more intermediate lift straps 16 spaced apart between them. Preferably, each lift strap is in the form of a loop 54 of a web of material with a bight 56 and two runs 58 each of which is connected to a side portion of the bag, and preferably to a reinforced strip 34 or area of the bag. Preferably, each run 58 of each loop 54 overlies a reinforcing strip 34 and is connected and attached to the bag by a series of stitches of thread 60 which greatly enhances the maximum load carrying capacity of the lift straps without tearing, separating or zippering in the area of the stitches attaching the lift straps to the bag.

As shown in FIG. 1, in each set of straps 12,14 the loops 54 of the corner straps 18 are interconnected by a linking member 20 which preferably also passes through the loop 54 of each intermediate lift strap 16 between them. Each linking member preferably is a web of flexible and substantially inextensible material with a closed loop 64 at each end, which encircles a corner lift strap 18 and is connected adjacent its end to an overlapping portion of the web by stitches 66. As shown in FIG. 1, each linking member 20 has an overall length, such that when it is in tension and the bag is filled and suspended by its lift straps, the corner straps 18 and the associated side edges 24 of the bag are generally parallel. This prevents the loops 54 or upper part of the corner straps 18 of each set 12,14 from being displaced substantially laterally outwardly of the plane of the adjacent transverse side wall 22 of the bag which would significantly increase the loading on the stitches connecting the corner loops 54 to the bag and hence increase the tendency of the corner straps 18 to tear away from the bag. Preferably, although not necessarily, the loop 54 of each intermediate strap 16 is also attached to the linking member 20, such as by stitches 66 so that its upper portions also extend generally parallel to its associated corner straps 18. This also reduces the tendency of the intermediate strap 16 to be torn away from the bag when the bag is filled and suspended or carried by its lift straps. The connecting together of the lift straps by the linking members 20 also facilitates alignment of their loops 54 for insertion of a lifting tine through the loops 54 of all of the straps of each set 12,14. This greatly facilitates and simplifies insertion and removal of the tines of a fork lift truck through all the loops 54 of both sets of the lift straps 12,14 for lifting, suspending, carrying and depositing a filled bag and removing the tines from the loops of a filled bag.

Figure 4:
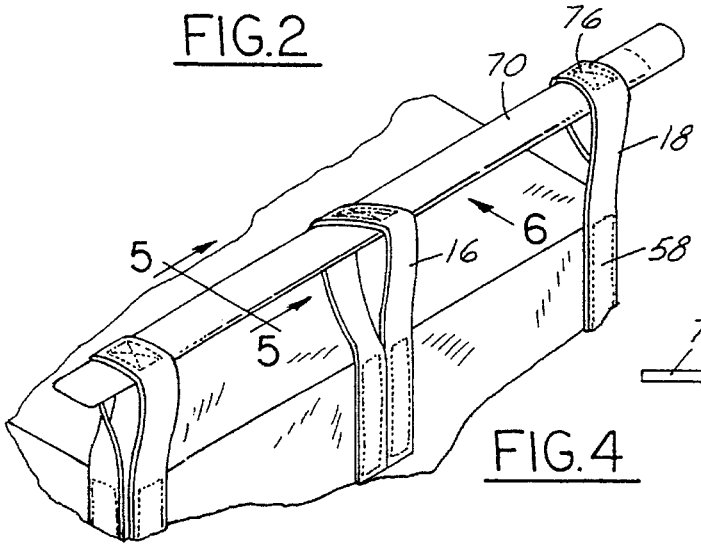
FIG. 4 is a fragmentary perspective view of one side of a bag illustrating the lift straps connected by a hollow elongate tube linking member.
Figure 5:
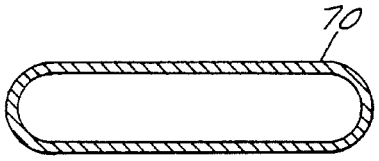
FIG. 5 is a sectional view taken on line 5—5 of FIG. 4 illustrating a preferred geometry of the hollow elongate tube linking member.
Figure 6:
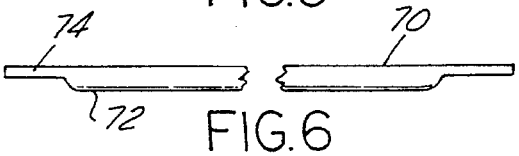
FIG. 6 is a fragmentary side view of a hollow elongate tube linking member.

FIGS. 4–6 show a modified linking member for each set of straps which is a hollow elongate tube 70 with an oval cross-section having a major diameter greater than the width of a lifting tine and a minor diameter less than the major diameter and greater than the thickness of a lifting tine, to allow the insertion of a lifting tine into an open end of the tube 70. Preferably, as shown in FIG. 6, the tube 70 at each end has a section of its lower wall portion 72 removed so that the upper wall portion 74 of the tube 70 projects outwardly beyond the lower wall portion 72 of the tube. This arrangement facilitates the alignment of a lifting tine with the tube 70 and also facilitates the insertion of the lifting tine through the tube 70. Initially, the tip of the tine is disposed under the outer edge of the upper wall portion 74 and then advanced through the tube 70.

While the tube 70 can be rigid, preferably it is made of a relatively thin plastic material which flexes sufficiently adjacent the bends of the outer edges of the major axis so that the central portion of the walls 72,74 will bear on each other when a bag is stacked on top of them. Preferably, the bight or central portion of the loop of each lift strap 16,18 of a set 12,14 is attached to the upper wall portion of the tube, such as by an adhesive or stitches 76.

As shown in FIG. 1, when the bag 10 is filled, it assumes a generally rectangular or cubical configuration with a pair of reinforced strips 34 extending along each side edge 24, and a pair of reinforcing strips 34 extending through the middle of the sides 22 and ends 26,28 and around substantially the entire periphery of the bag 10. This provides a filled bag 10 which can be stacked, and one which is strategically reinforced thereby providing optimal use of the woven fabric material of the bag. To move the bag 10, such as for lifting, stacking or transportation, a pair of lifting tines, usually of a fork lift truck, are inserted under and parallel to the linking member 20 of each set of lift straps 12,14 and advanced horizontally so that the lifting tines move through the loops 54 of all the lift straps 16,18 connected by the linking members 20. The tines are raised vertically in unison to lift and suspend the bag. When suspended, the bag 10 is supported by four corner lift straps 18 and two middle lift straps 16, providing a better distribution of the load as compared to previous bags, which increases the load bearing capacity of the bag 10. Furthermore, the linking members 20 maintain the lift straps in a vertical and parallel relationship to each other and the side edges 24 of the filled and suspended bag which decreases the tendency for them to tear away from the bag and thereby increases their load bearing capacity.

A filled bag 10 can also be lifted and moved by inserting a pair of tines of a lift truck horizontally, generally perpendicular to and under the linking members 20 and inboard of and preferably immediately adjacent the corner straps 18 so that the tines underlie both of the linking members 20. After the tines are fully inserted horizontally under both linking members 20, the tines are raised vertically in unison to lift and suspend the bag 10.

If desired, a separate intermediate lift strap 16 can be attached to each of the four sides 22 of the bag and preferably to a reinforced strip 34 adjacent the center and the top edge of each side. With this arrangement, a pair of tines of a lift truck can be inserted from any side of the bag 10 and will pass through and engage all four corner lift straps 18 and a pair of intermediate straps 16.

Alternatively, when the hollow elongate tube linking members 70 are used, the lifting tines are inserted completely through the tubes 70, and thus, through the loops 54 of all the lift straps 16,18 of the bag.

What is claimed is:

1. A collapsible bag comprising; a blank of reinforced flexible woven material arranged to provide generally rectilinear sides of a bag with reinforced strips adjacent side edges of the bag and adjacent the middle of two generally opposed sides, lift straps adjacent each upper corner and adjacent the middle of each of the two generally opposed sides, each of said straps having a loop with a bight and two runs, each run of each strap attached to a reinforced strip of the material of the sides of the bag, a pair of substantially inextensible linking members each connected to a pair of lift straps adjacent a pair of corners of the bag and in engagement with a middle lift strap disposed between said pair of lift straps connected to said linking member.

2. The collapsible bag of claim 1 wherein said substantially inextensible linking member comprises a strap of flexible material.

3. The collapsible bag of claim 1 wherein said substantially inextensible linking member comprises a strap of material with an overall length such that when said strap of material is in tension the loops of the corner straps attached to said strap of material are substantially parallel to each other when the bag is filled and suspended by the lift straps.

4. The collapsible bag of claim 3 wherein said tubular blank of reinforced flexible woven material comprises a woven fabric material with each of said reinforced strips having a pluralilty of warp threads spaced closer together than the warp threads of the non-reinforced areas of the woven fabric material and all of the warp threads are of the same material and have substantially the same nominal tensile strength.

5. The collapsible bag of claim 4 which also comprises a lift strap adjacent the middle of each side of the bag, each lift strap having a loop with a bight and two runs, and each run being attached to a side of the bag.

6. The collapsible bag of claim 1 wherein said substantially inextensible linking member comprises an elongate tube extending between a pair of corner straps and a middle strap between said pair of corner straps, with said tube having an oval cross-section with a major diameter greater than the width of a lifting tine and a minor diameter less than the major diameter and greater than the thickness of a lifting tine.

7. The elongate tube of claim 6 having upper and lower wall portions wherein a section of said lower wall portion is removed from both ends of said tube, such that the upper wall portion extends beyond the lower wall portion at both ends of said tube.

8. The elongate tube of claim 6 wherein the walls of said tube are of a flexible material.

9. The elongate tube of claim 6 wherein the walls of said tube are of a flexible and at least somewhat resilient plastic material.

10. The collapsible bag of claim 1 wherein said lift straps are connected to said bag with a series of stitches of thread.

11. The collapsible bag of claim 1 wherein said linking members are connected to said lifting straps with a series of stitches of thread.

12. The collapsible bag of claim 1 wherein said tubular blank of reinforced flexible woven material comprises a woven fabric material with each of said reinforced strips having a plurality of warp threads spaced closer together than the warp threads of the non-reinforced areas of the woven fabric material and all of the warp threads are of the same material and have substantially the same nominal tensile strength.

13. The collapsible bag of claim 1 which also comprises a lift strap adjacent the middle of each side of the bag, each lift strap having a loop with a bight and two runs, and each run being attached to a side of the bag.

* * * * *